United States Patent [19]

Zollner et al.

[11] 4,289,935

[45] Sep. 15, 1981

[54] METHOD FOR GENERATING ACOUSTICAL VOICE SIGNALS FOR PERSONS EXTREMELY HARD OF HEARING AND A DEVICE FOR IMPLEMENTING THIS METHOD

[75] Inventors: Manfred Zollner; Christian Hoffmann, both of Munich; Eberhard Zwicker, Icking, all of Fed. Rep. of Germany

[73] Assignee: Siemens Aktiengesellschaft, Berlin & Munich, Fed. Rep. of Germany

[21] Appl. No.: 125,046

[22] Filed: Feb. 27, 1980

[30] Foreign Application Priority Data

Mar. 8, 1979 [DE] Fed. Rep. of Germany ..... 2908999

[51] Int. Cl.[3] ..... H04R 25/00

[52] U.S. Cl. ..... 179/107 FD

[58] Field of Search ..... 179/107 FD

[56] References Cited

U.S. PATENT DOCUMENTS

| | | | |
|---|---|---|---|
| 3,385,937 | 5/1968 | Lafon | 179/107 |
| 3,600,524 | 8/1971 | Biondi et al. | 179/107 FD |
| 3,819,875 | 6/1974 | Velmans | 179/107 FD |

FOREIGN PATENT DOCUMENTS

| | | | |
|---|---|---|---|
| 2613513 | 10/1977 | Fed. Rep. of Germany | 179/107 FD |

OTHER PUBLICATIONS

Speech Analysis Synthesis Error Perception, Flanagan, 1972, Springer-Verlag, pp. 323-326.

Experiments in Hearing, Von Bekesy, 1960, McGraw-Hill, pp. 546, 552, 563, 567, 596, 602 & 634.

New Scientist, Jan. 26, 1978, p. 219 "Hearing by the Skin of Your Body".

IEEE Trans. on Acoustics, Speech and Signal Processing, vol. ASSP-24, No. 6, pp. 473-480, Dec. 1976, A Hearing Aid for Subjects with Extreme High-Frequency Losses, Knorr.

*Primary Examiner*—George G. Stellar

*Attorney, Agent, or Firm*—Hill, Van Santen, Steadman, Chiara & Simpson

[57] ABSTRACT

In an exemplary embodiment, the signals to be transmitted are converted into electric signals and resolved into a multiplicity of frequency bands by means of filters. The signals coming from the filters are then employed for the modulation of tone signals. Finally, original tones are supplied to the person hard of hearing together with the modulated tones as the auditory signal. To this end, the disclosure provides that the resolution ensues into at least three frequency bands and that the frequencies of the modulated tones are adapted to the residual frequency band of the person hard of hearing and that all of the signals to be transmitted are transmitted together with the modulated tones and that the ratio of the loudness of the original tones and that of the modulated tones is set at a ratio which is useful for the person hard of hearing. For transmission to the person hard of hearing, standard earpieces can be employed or implanted devices with direct electric transmission of the signals to the auditory nerves. Disclosed methods and devices are particularly employable as a hearing aid device for persons who are very hard of hearing or who have total hearing impairment.

33 Claims, 1 Drawing Figure

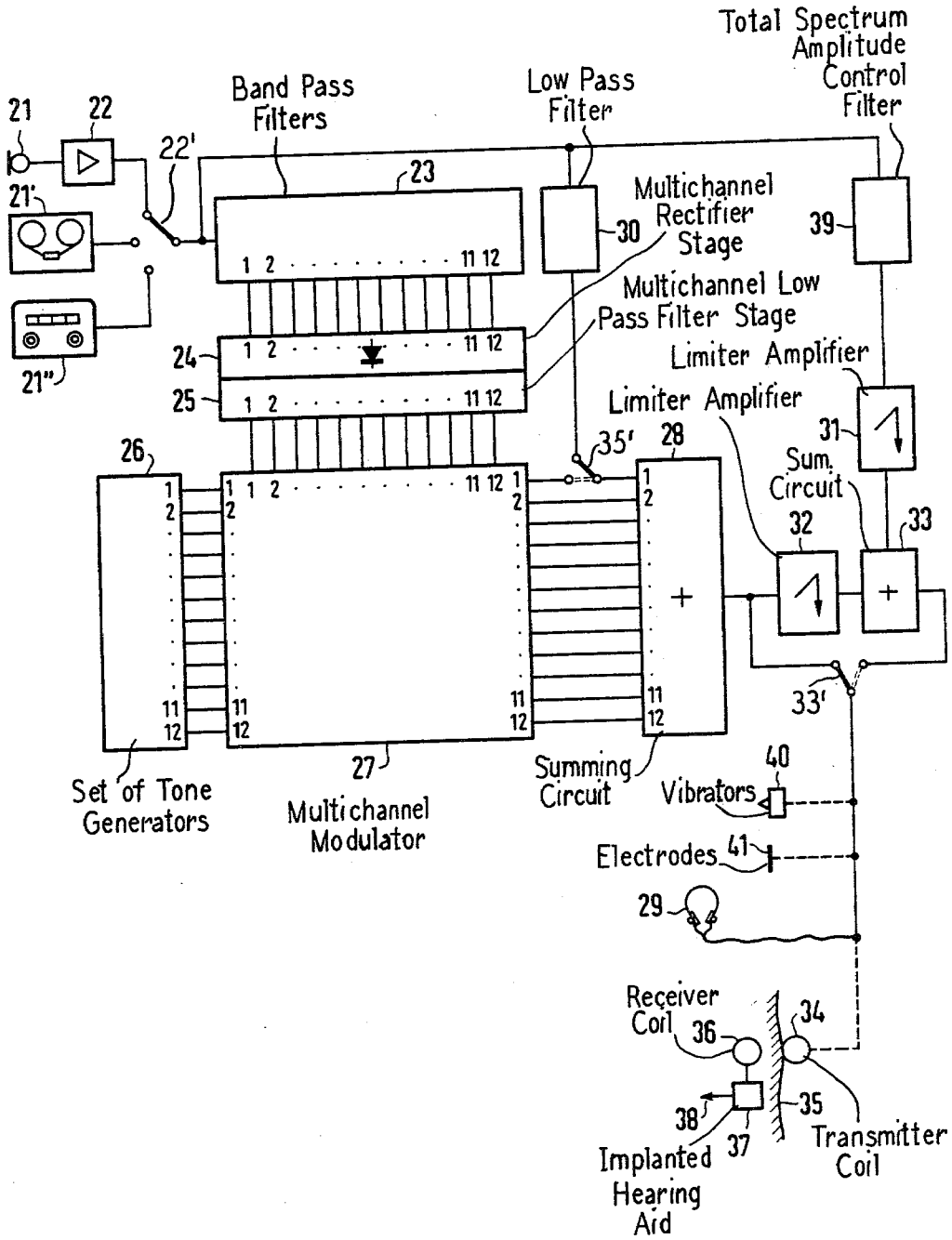
Total Spectrum Amplitude Control Filter
Band Pass Filters
Low Pass Filter
21
22
22'
21'
21"
23
30
39
Multichannel Rectifier Stage
Multichannel Low Pass Filter Stage
24
25
Limiter Amplifier
Limiter Amplifier
31
35'
28
26
Sum. Circuit
32
33
33'
Set of Tone Generators
27
Multichannel Modulator
Summing Circuit
40
Vibrators
Electrodes
41
29
Receiver Coil
36
34
35
38
37
Implanted Hearing Aid
Transmitter Coil

METHOD FOR GENERATING ACOUSTICAL VOICE SIGNALS FOR PERSONS EXTREMELY HARD OF HEARING AND A DEVICE FOR IMPLEMENTING THIS METHOD

BACKGROUND OF THE INVENTION

The invention relates to a method for supplying persons extremely hard of hearing with acoustical signals according to the generic (introductory) part of claim 1 and devices for implementing this method. Such methods and devices are known, for instance, from the U.S. Pat. No. 3,385,937.

A hearing aid with a microphone for conversion of the acoustical signals received into electrical signals is known from the aforementioned reference, in which those signals which are allowed to pass by filters are employed for the modulation of an electric auxiliary AC voltage, the resultant modulated a.c. signal being supplied after amplification and conversion as acoustical signals in an ear piece for the ear to be supplied. In such a system, the filters are to be designed such that they only allow signals to pass whose frequencies either lie between 1500 and approximately 3500 Hz or between a first value of the range 4500 through 6000 Hz and a second value of the range 7000 through 8000 and that the frequency of the electrical carrier voltage lies between 350 and 1000 Hz. The part of the signals coming from the microphone lying below approximately 1000 Hz can be added to such a modulated signal or, respectively, to a pair of such modulated signals. Such hearing aids, however, have not been able to prevail in hearing device technology since, for a single filter, the filter breadth 1500 Hz through 3500 Hz is too broad and, upon employment of two filters, the filter breadths are too small and important speech information is not placed at the disposal of the hard of hearing.

SUMMARY OF THE INVENTION

Given a method for supplying persons extremely hard of hearing with acoustical signals according to the generic part of claim 1, the object of the invention is to select the signals to be transmitted such that, in addition to good intelligibility, a simplification of the apparatus construction becomes possible. This object is inventively achieved by means of the features cited in the characterizing part of this claim.

The invention proceeds from the fact that language can be greatly reduced in terms of its information content without thereby essentially losing intelligibility and that fluent speech can still be well understood even given a syllable intelligibility of 50%. It therefore makes use of converting a part of the speech information to be transmitted into amplitude-modulated sinusoidal or rectangular tone signals and mixing these with the original speech signals. If, for example, the higher frequency speech range lying approximately between 1 and 8 kHz, or, respectively, 2 and 8 kHz is transmitted at the residual hearing range of 500 Hz through 1 kHz or, respectively, 1 kHz through 2 kHz in the form of a plurality of modulated tones, then, after a learning phase, the identifiability of fricatives and stops such as s, ʃ, x, t is increased to over 90% certainty. Without this conversion, however, these sounds could only be guessed at.

In contrast to a method according to U.S. Pat. No. 3,385,937, an improvement of intelligibility is obtained because the information necessary for understanding speech is transmitted to persons hard of hearing in the necessary multiplicity of amplitude-modulated tones. Moreover, the advantage is achieved that, by means of transmitting the entire voice signal, the person who is hard of hearing can exploit all speech information which is made available to him in a direct manner.

As a device for converting normal acoustical tones into, for example, pure tones, a channel vocoder can be employed as is employed for devices for speech synthesis (cf., for example, Flanagan, J. L., "Speech Analysis Synthesis and Perception", Springer-Verlag, Berlin, Heidelberg, New York, Second edition (1972), pages 321-326). In such a vocoder, speech is simulated, given voiced sounds, by means of a spectrum consisting of equidistant spectral lines. Thereby, neighboring spectral lines are collected to form frequency bundles and are modulated in amplitude. For voiceless sounds, one switches from a line spectrum to a noise spectrum. Proceeding therefrom, such a vocoder can be simplified in that, on the one hand, voiceless sounds are also simulated by means of a line spectrum, for instance in that the changeover to a noise spectrum is omitted. On the other hand, one can attempt to reduce the number of the lines of the spectrum. A first limiting value for this is achieved when, in each frequency band, only one line remains, for example that line which lies at the mean frequency of the respective channel. This is based on the fact that, for example given a voice base frequency of 100 Hz, six lines can lie in the frequency band between 2050 Hz and 2650 Hz which, however, are collected into a single line at 2350 Hz. A second limiting value is derived when the number of the frequency bands is reduced to so few that the speech is no longer understood because significant parts of the speech information are no longer transmitted.

Upon employment of methods standard in audiometry, for example the "Freiburger Speech Intelligibility Test", an appropriate examination can ensue. Thereby, the individual words can be separated from one another by a pause of approximately 2 seconds and can be offered without repetition. A test can embrace 150 words of which none appear multiply. Thereby, after an acclimatization phase lasting for approximately 15 words, 30 words per partial test can be offered in the actual test.

Although fricatives and stops—reproduced by means of individual amplitude-modulated pure tones—sound unnatural, they are recognized without difficulty after a short familiarization phase. This result makes it clear that sufficient information concerning the linguistic content is already contained in the power spectrum of spoken language.

A phase-lock coupling of the individual partial tones seems no more necessary than the reproduction of specific harmonics of the original spectrum. In order to examine the effects of a misplacement between the analysis frequency $f_m$ and the synthesis frequency $f_G$, all generator frequencies $f_G$ were reduced to 0.7 times their original value in two experiments. By so doing, intelligibility in a 6-line spectrum sank from 94% to 92%, in a 3-line spectrum from 60% to 55%.

In addition to comprehension of monosyllables, the intelligibility of fluid speech was also judged. It was thereby shown that fluid speech can be well understood when the monosyllable comprehension lies at or above 50%, i.e., given a spectrum with at least 3 lines. If, instead of the lowest spectral line, the low pass filtered component of the original speech ($f_G$=250 Hz) is transmitted, the naturalness of fluid speech can be significantly increased.

In particular, it then becomes possible to distinguish between a male and female speaker, even though the monosyllabic comprehension is practically not improved.

In persons with impaired hearing with a pronounced loss of high tones, one can attempt to transform the speech frequency range to the residual hearing range with the assistance of a vocoder with, for example, 11 channels. In order to achieve that, it would lie close at hand to first off-tune all generator frequencies $f_G$ in such manner that they are theoretically uniformly distributed over the residual hearing frequency range, i.e., for example given an upper hearing limit of 1100 Hz, to generate an equidistant spectrum in the range 100 Hz through 1 kHz. However, the "transformed speech" generated in that manner is considered to be incomprehensible by the patient. In an experiment which led to the invention, therefore, the original speech was also transmitted unfiltered. For compensation of the said loss of high tones, the vocoder-transformed component contains the higher-frequency speech range (1 kHz through 8 kHz or, respectively, 2 kHz through 8 kHz) which was converted to the upper residual hearing range (500 Hz through 1 kHz or, respectively, 1 kHz through 2 kHz). Even with this type of offering, at first the speech comprehension was hardly increased, i.e. at the beginning of the experiments; after a learning phase of approximately 1 hour, however, the sounds s, ʃ, x, t could already be recognized with greater than 90% certainty. Without a vocoder, these sounds could only be guessed at.

The loudness relation between original speech and vocoder spectrum is to be determined individually for each patient, because the remaining hearing varies greatly from patient to patient and both the residual hearing frequency range as well as loudness sensing function exhibit very strong individual deviations. Two limiter/amplifiers which are inserted in the respective signal paths, i.e. in the path of the original signal and in that of the vocoder signal, have proven very helpful for the adjustment, because, by so doing, the mutual masking of the two signals can be kept small given an informational transmission which is still sufficient. With them, the total loudness could also be set to a value which was comfortable for the patient.

Other than pure (sinusoidal) tones, others, such as rectangular or triangular waveform tones can also be employed. For example, rectangular waveform generators can be advantageously employed particularly given steep loss of high tones and, like triangular waveform generators, are easier to manufacture than pure tone generators.

Further details and advantages of the invention are further explained below on the basis of the exemplary embodiment illustrated in the FIGURE of drawing; and other objects, features and advantages will be apparent from this detailed disclosure and from the appended claims. The specific claimed embodiments represent examples of the application of the invention to different types of hearing loss and are hereby incorporated into the Detailed Description.

BRIEF DESCRIPTION OF THE DRAWING

The single FIGURE is an electric circuit diagram for illustrating an embodiment of the present invention.

DETAILED DESCRIPTION

The expedient employment of a 12-channel vocoder for simulating the voice frequencies for the implementation of the inventive hearing aid method is illustrated in the FIGURE in block diagram.

The acoustic signals picked up in a microphone 21 and converted into electric signals are supplied to a set of band pass filters 23 via a preamplifier 22. This filter set 23 is the input part of a vocoder which comprises the component parts 23 through 28. The input acoustic signals, however, can also come from a tape recorder 21' or some other acoustic transducer 21'', for instance a radio receiver. By means of an appropriate setting of the switch 22', they are then selectively connected to the set of band pass filters 23. The latter contains twelve band pass filters with outputs numbered 1 through 12. The individual filters have mean frequencies ($f_m$) of 225 Hz, 365 Hz, 515 Hz, 690 Hz, 915 Hz, 1.2 kHz, 1.6 kHz, 2.2 kHz, 2.9 kHz, 4.1 kHz, 5.8 kHz and 8.3 kHz. The band width of the individual filters respectively corresponds to approximately $\Delta f = 30\% \cdot f_m$ ($f_m$ = mean frequency) or 1.5 bark. Measured at the mean frequency, the channel separation of neighboring filters amounts to eleven through seventeen decibels. The voltages at the outputs Nos. 1 through 12 are supplied to corresponding single-wave (half wave) rectifiers of rectifier stage 24 and subsequently pass through a respective low pass filter of the second stage 25 for smoothing. The response time of the low pass stage 25 is longer for the chnnels of the lowest mean frequency than for those of the remaining mean frequencies and amounts, for example, for the lowest six channels, to 40 ms and to 8 ms for the remaining channels. The envelopes of the individual signals of channels Nos. 1 through 12 after processing in the foregoing manner then modulate the tones coming from a set of generators 26 with the frequencies $f_G$ (G=1–12) in a multichannel modulator 27. Thereby, in the case of persons whose impaired hearing covers a normal frequency spectrum, the frequencies $f_G$ to be modulated respectively correspond to the mean frequency $f_m$ of the respective appertaining band pass filter of component 23. The outputs of the modulator 27 lead to a summing circuit 28 and are combined there to form a uniform frequency spectrum. They can then be directly conducted to a headset 29 via a switch 33' (in the left-hand position shown). This headset can be an airborne sound earpiece or a bone-conduction earpiece.

Instead of the lowest modulated pure tone in channel 1, a component of the original speech obtained via a low pass filter 30 can be optionally added to the synthetic speech. Filter 30 is connected to bypass multichannel modulator 27 via a switch 35'. It thereby becomes possible to also transmit the original pitch e.g. for frequencies below about 250 Hertz, with switch 35' in the upper position shown, even when the switch 33' is in the left-hand position shown.

The synthetic speech generated by the vocoder 23 through 28 is offered to the person hard of hearing at both ears via the headset 29.

In the case of persons with impaired hearing with, for example, pronounced loss of high tones, a compensation can be achieved by means of transformation of the speech frequency range into the residual hearing range. To that end, the frequencies $f_G$ of the set of generators 26 are set in such manner that the speech intelligibility becomes optimum, i.e., for example, in the case of loss of high tones, higher-frequency components of 1 kHz through 8 kHz, or, respectively, 2 kHz through 8 kHz are transmitted at the residual hearing range of 500 Hz through 1 kHz or, respectively, 1 kHz through 2 kHz. This produces a signal which puts persons hard of hearing in a position after a learning phase of approximately one hour to recognize linguistic information with high frequency components, for example the sounds s, ʃ, x, t, with over 90% certainty. On the other hand, the said sounds can only be guessed at without a vocoder 23 through 28.

The loudness ratio between original speech from the microphone 21 and the microphone amplifier 22 and the vocoder spectrum from 23 through 28 must be individually determined and set for each patient. Thereby, it has proven to be of great help to employ two limiter/amplifiers 31 and 32 which are connected into the respective signal paths as shown. The signals from these two amplifiers 31 and 32 are then brought together in a summing circuit 33 and supplied to the headset 29 via a switch 33' when this switch 33' is moved from the left-hand position illustrated in the FIGURE to the right-hand position indicated by dash lines. The input to limiter/amplifier 31 is from total spectrum amplitude control filter whose input is directly connected to switch 22'.

The inventive arrangement also allows implanted hearing aids to be employed. Given these, the preparation of the signals as a rule ensues in a main device. From this, the signals to be transmitted to the hearing are then supplied wirelessly, for instance inductively or by means of ultrasonics, or over wires to the implanted part of the device. Such devices are described, for example, in the periodical HNO 26 (1978), pages 77 through 84.

In a device according to the FIGURE illustrated, the transmission into a hearing aid 37 implanted in the body 35 can ensue wirelessly in that, instead of the headset 29, a transmitter, for example a transmitter coil 34, is connected to which an appropriate receiver, for example receiver coil 36, is allocated which, for example, can be implanted behind the ear. Likewise, a corresponding device 37 is implanted to which an arrangement of electrodes referenced with 38 is connected which are allocated to the auditory nerve endings. In the present conjunction, thereby, the advantage is offered that the number of electrodes can be kept small (corresponding to a relatively restricted given sensory spectrum) because, by means of speech recoding in the circuit described, the informational flow is reduced to the magnitude necessary for comprehension.

In particular, this advantage can be of significance when speech information is to be transmitted in another manner to persons with hearing impairment which ranges from extreme to total. To that end, vibrotactile or electrocutaneous stimulation, for example, are employed in a known manner (cf., for example, the book "Experiments in Hearing", Georg von Bekesy (1960), McGraw-Hill Book Company, Inc. New York, Toronto, London (1960), pages 563 and 596; and the periodical "New Scientist" (Jan. 26, 1978), pages 219, "Hearing By the Skin of Your Body"). Thereby, in contrast to hearing, only a minimum information flow can be transmitted because the sensitivity (given sensory spectrum) of the cutaneous senses which the stimulation influences is less than that of hearing. For applying the said stimulations, so-called vibrators 40 or, respectively, electrodes 41 as electrocutaneous stimulators are employed as transmitters, as are indicated in the FIGURE as a replacement for the head set 29.

For the sake of specific examples the set of tone generators 26 may supply the following square wave or triangular wave frequencies $f_{G1}$ through $f_{G12}$ to the modulators of channels No. 1 through 12:

Case A, with the hearing of the individual having a spectral sensitivity covering a range up to at least about eight kilohertz, each tone generator supplying a frequency $f_G$ corresponding to the mean frequency of the associated band pass filter of component 23, i.e. $f_{G1}=f_{m1}=225$ Hz, . . . , $f_{G12}=f_{m12}=8.3$ kHz; switch 35' being in its lower position shown dotted in the FIGURE, and switch 33' being in its right-hand position shown dotted in the FIGURE; or Case B, with the hearing of the individual having a spectral sensitivity covering a range up to about 1.1 kilohertz, the frequencies $f_G$ of the tone generators being equally distributed between about 500 Hertz and about one kilohertz, e.g. $f_{G1}=500$ Hz, $f_{G2}=550$ Hz, $f_{G3}=600$ Hz, . . . , $f_{G10}=950$ Hz, $f_{G11}=1{,}000$ Hz, $f_{G12}=1{,}050$ Hz; the frequencies $f_G$ thus comprising equidistant spectral lines with a separation of about 50 Hz and covering an upper portion of the patient's given sensory spectrum above an intermediate frequency (of about 500 Hz); the positions of switches 33' and 35' being as in Case A; or Case C, with the hearing of the individual having a spectral sensitivity covering a range up to about two kilohertz, the frequencies $f_G$ of the tone generator being equally distributed between about one kilohertz and about two kilohertz, e.g. $f_{G1}=900$ Hz, $f_{G2}=1{,}000$ Hz, $f_{G3}=1{,}100$ Hz, . . . $f_{G10}=1{,}800$ Hz, $f_{G11}=1{,}900$ Hz, $f_{G12}=2{,}000$ Hz, the equidistant spectral lines having a separation of about 100 Hz and covering an upper portion of the patient's sensory spectrum beginning at an intermediate frequency in the patient's sensory range (of about 900 Hz); the switches 33' and 35' being in the dotted positions as in Cases A and B.

Cases A1, A2, Case B1, B2, Case C1, C2

For the spectral sensitivies of Cases A, B, and C, respectively, (1) the modulator 27 has six channels with six tone generators supplying frequencies $f_G$:

Case A1 between about 225 Hz and about six kilohertz, equal to the mean frequencies of six associated band pass filters, and distributed analogously to the mean frequencies of the band pass filters 23, i.e. $f_{G1}=f_{m1}=225$ Hz, $f_{G2}=f_{m2}=515$ Hz, $f_{G3}=f_{m3}915$ Hz, $f_{G4}=f_{m4}=1.6$ kHz, $f_{G5}=f_{m5}=2.9$ kHz, and $f_{G6}=f_{m6}=5.8$ kHz (the band pass filters having a pass range of sixty percent of the associated mean frequency $f_m$); switches 33' and 35' being in the dotted positions as in Case A; or Case B1 between about 500 Hz and about 1,000 Hz, and providing six equidistant spectral lines with a separation of 100 Hz therebetween; e.g. $f_{G2}=500$ Hz, $f_{G3}=600$ Hz, . . . , $f_{G6}=900$ Hz, $f_{G7}=1{,}000$ Hz; the band pass filters of channels No. 2 through 7 receiving the input electrical signal via switch 22' and together transmitting a spectrum between about 250 Hz and about eight kilohertz with mean frequencies e.g. of $f_{m2}=365$ Hz, $f_{m3}=690$ Hz, $f_{m4}=1.2$ kHz, $f_{m5}=2.2$ kHz, $f_{m6}=4.1$ kHz, $f_{m7}=8.3$ kHz; (The switch 35' may be in the upper position shown, and low pass filter 30 may transmit the low frequency components not effectively transmitted by channel No. 2, e.g. frequencies below about 250 Hz.

Filter 30 together with fitler 39 may transmit the total spectrum of the input signal supplied via switch 22', and switch 33' may be in its right-hand position shown dotted in the FIGURE); or Case C1 between about 1,000 Hz and about 2,000 Hz, and providing six equidistant spectral lines with a separation of 200 Hz therebetween; the other conditions being as described for Case B1; or (2) the modulator 27 has three channels, Nos. 2, 3, and 4, in addition to channel No. 1 which may be bypassed by means of switch 35', with three tone generators supplying frequencies $f_G$:

Case A2 between about 500 Hz and about six kilohertz, and distributed analogously to the frequencies of the band pass filters 23, e.g. $f_{G2}=f_{m2}=515$ Hz, $f_{G3}=f_{m3}=1.6$ kHz, $f_{G4}=f_{m4}=5.8$ kHz; the channel No. 1 being inactive, and switches 33' and 35' being in the dotted positions; or Case B2 between about 500 Hz and about 1,000 Hz and providing three equidistant spectral lines, e.g. $f_{G2}=500$ Hz, $f_{G3}=750$ Hz, $f_{G4}=1{,}000$ Hz, channels No. 2, 3, and 4, covering the input frequencies above 250 Hz, and receiving frequency bands, for example, with mean frequencies of $f_{m2}=515$ Hz, $f_{m3}=1.6$ kHz, $f_{m4}=5.8$ kHz; switch 35' being in the upper position shown to supply low frequency components not transmitted by the band pass filter of channel No. 2, switch 33' being in the right-hand position indicated by dotted lines in the FIGURE, and filters 30 and 39 together transmitting the total spectrum of the input signal from switch 22'; or Case C2 between about 1,000 Hz and about 2,000 Hz, and providing three equidistant spectral lines e.g. $f_{G2}=1{,}000$ Hz, $f_{G3}=1{,}500$ Hz and $f_{G4}=2{,}000$ Hz; the other conditions being as described for Case B2.

It will be apparent that many modifications and variations may be effected without departing from the scope of the novel concepts and teachings of the present invention.

We claim as our invention:

1. A method for generating acoustical voice signals which are intelligible to persons extremely hard of hearing, but having a sensory response to frequencies in a given sensory spectrum, comprising:

(a) supplying an input signal in accordance with an acoustical voice signal to be made intelligible to an individual with a given sensory spectrum, (b) dividing the input signal into a plurality of frequency bands to provide output signals of different frequency bands, (c) modulating alternating waveform signals of different frequencies within the given sensory spectrum with the envelopes of the output signals of said different frequency bands, to provide modulated tone signals, (d) combining the modulated tone signals with frequency components of the input signal, and supplying the resultant signal to the individual having said given sensory spectrum, wherein the improvement comprises (e) dividing the input signal in accordance with the acoustical voice signal, into at least three frequency bands to thereby provide output signals in a multiplicity of different frequency bands with respective mean frequencies ($f_m$), (f) modulating a multiplicity of alternating current waveforms of different frequencies ($f_G$) within the given sensory spectrum with the envelopes of respective ones of said output signals in said multiplicity of different frequency bands, to provide a multiplicity of modulated tone signals, (g) combining the multiplicity of modulated tone signals with the total spectrum of said input signal, and supplying the resultant total spectrum combined signal to the individual having said given sensory spectrum, and (h) adjusting the ratio of the loudness of the multiplicity of modulated tone signals with respect to the loudness of said input signal, and also adjusting the loudness of the resultant total spectrum combined signal, both adjustments being made in relation to the specific sensory characteristics of the individual person having said given sensory spectrum.

2. A method according to claim 1, characterized in that a multiplicity of sinusoidal waveform signals are modulated with the envelopes of respective ones of said output signals in said multiplicity of different frequency bands.

3. A method according to claim 1, characterized in that a multiplicity of rectangular waveform signals are modulated with the envelopes of respective ones of said output signals in said multiplicity of different frequency bands.

4. A method according to claim 1, characterized in that a multiplicity of triangular waveform signals are modulated with the envelopes of respective ones of said output signals in said multiplicity of different frequency bands.

5. A method according to claim 1 utilizing a multichannel modulator having respective channels with first and second inputs and having a set of tone generators for supplying respective ones of said multiplicity of alternating current waveforms of said different frequencies ($f_G$) to the respective first inputs of the respective channels, and having respective ones of said second inputs arranged for receiving respective ones of said output signals in said multiplicity of different frequency bands, and having respective channel outputs for supplying said multiplicity of modulated tone signals.

6. A method according to claim 5 with said multichannel modulator having not more than twelve channels.

7. A method according to claim 5 with said multichannel modulator having three channels.

8. A method according to claim 5 with said multichannel modulator having six channels.

9. A method according to claim 5 with said multichannel modulator having twelve channels.

10. A method according to claim 5 characterized in that the set of tone generators supply a multiplicity of alternating current waveforms of respective different frequencies ($f_G$) which are substantially uniformly distributed over a frequency range within said given sensory spectrum.

11. A method according to claim 5 further characterized in that the tone generators supply a multiplicity of respective different frequencies ($f_G$) substantially corresponding to the mean frequencies ($f_m$) of the respective ones of said multiplicity of different frequency bands.

12. A method according to claim 5 with the different frequency bands having band widths corresponding to about thirty percent of the associated mean frequency.

13. A method according to claim 5, with the set of tone generators supplying respective frequencies ($f_G$) different from the respective mean frequencies ($f_m$) of the respective channels.

14. A method according to claim 13, with the set of tone generators each supplying a frequency which lies in the range between the mean frequency of the associated channel and about one-half the mean frequency of the associated channel.

15. A method according to claim 1, characterized by a converter for converting speech signals into an input signal which can be processed in a set of band pass filters connected to the converter; in that the outputs of the filters have connected therewith rectifiers and smoothing low pass filters whose response time lies between forty milliseconds and eight milliseconds; in that tone generators have outputs for supplying tone frequencies ($f_G$) which correspond to the mean frequencies ($f_m$) of the filters; and in that the modulated tone signals are conducted into a summing circuit which is followed by a signal transmitter which can be brought into electro-acoustical contact with the individual person who is hard of hearing.

16. A method according to claim 15, characterized in that the tone generators supply sinusoidal or rectangular or triangular waveforms.

17. A method according to claim 15, characterized in that the signal transmitter to the person hard of hearing is a head set.

18. A method according to claim 15, characterized in that the transmitter is a transmitter directly connected to the output of the summing circuit which can work in conjunction with the receiver of an implanted hearing aid equipped for stimulation of the auditory nerves.

19. A method according to claim 9, further characterized in that the mean frequencies of the frequency bands lie at 225 Hz, 365 Hz, 515 Hz, 690 Hz, 915 Hz, 1.2 kHz, 1.6 kHz, 2.2 kHz, 2.9 kHz, 4.1 kHz, 5.8 kHz and 8.3 kHz; the band width of the individual frequency bands amounts to approximately thirty percent of the mean frequency and the channel separation measured at the mean frequency amounts to eleven through seventeen decibels; and in that smoothing low pass filters are present at the second inputs to said modulator, the response time of the smoothing low pass filters for the lower six channels amounts to forty milliseconds and to eight milliseconds for the remaining channels.

20. A method according to claim 19, characterized in that the lowest modulated tone generator can be optionally replaced via a switch by means of a low pass filter to which the input signal is connected.

21. A method according to claim 19, characterized in that the combining of the input signal with modulated tone signals ensues via a respective limiter/amplifier through which the respective signal path is coupled.

22. A method according to claim 1, characterized in that the frequencies of the tone generators are individually set to the residual hearing capability of the individual person hard of hearing in such manner that the intelligibility of the speech becomes optimum.

23. A method according to claim 21, characterized in that the input signal is conducted via a filter (39) whose attenuation curve is set in such manner that optimum speech intelligibility ensues for the patient.

24. A method according to claim 15, characterized in that the signal transmitter is a bone-conduction earpiece.

25. A method according to claim 15, characterized in that the signal transmitter is a vibrator (40) vibro-tactile stimulator).

26. A method according to claim 15, characterized in that the signal transmitter is an electrocutaneous stimulator (41).

27. A method according to claim 10 wherein the set of tone generators supply a multiplicity of alternating current waveforms of respective different frequencies substantially uniformly distributed over a frequency range from about 500 Hertz to near the upper limit of the given sensory spectrum.

28. A method according to claim 10 wherein the set of tone generators supply a multiplicity of alternating current waveforms of respective different frequencies substantially uniformly distributed over a frequency range from about 1000 Hertz to near the upper limit of the given sensory spectrum.

29. A method according to claim 1 further characterized by deriving from the input signal by means of a low pass filter a low pass component of said input signal and combining said low pass component with the multiplicity of modulated tone signals to provide a mixed signal, and separately controlling the amplitude of the mixed signal and the remaining spectrum of the input signal prior to combining thereof.

30. A method for generating acoustical voice signals which are intelligible to persons extremely hard of hearing, but having a sensory response to frequencies in a given sensory spectrum, comprising:

(a) supplying an input signal in accordance with an acoustical voice signal to be made intelligible to an individual with a given sensory spectrum (b) dividing the input signal into a plurality of frequency bands to provide output signals of different frequency bands, (c) modulating alternating waveform signals of different frequencies within the given sensory spectrum with the envelopes of the output signals of said different frequency bands, to provide modulated tone signals, (d) combining the modulated tone signals with frequency components of the input signal, and supplying the resultant signal to the individual having said given sensory spectrum, wherein the improvement comprises (e) dividing the input signal in accordance with the acoutical voice signal, into at least three frequency bands to thereby provide output signals in a multiplicity of different frequency bands with respective mean frequencies ($f_m$), (f) modulating a multiplicity of alternating current waveforms of different frequencies ($f_G$) within the given sensory spectrum with the envelopes of respective ones of said output signals in said multiplicity of different frequency bands, to provide a multiplicity of modulated tone signals, (g) selecting the different frequencies ($f_G$) of the alternating current waveforms to be proportionate with respective frequencies of the input signal above a given low frequency limit, and (h) combining with the multiplicity of modulated tone signals only one low pass component of the input signal.

31. A method according to claim 30, with said low pass component of the input signal lying below about two hundred and fifty Hertz.

32. A method according to claim 30, with the different frequencies ($f_G$) being equal to a specific percentage of, and less than, respective mean frequencies ($f_m$) of the multiplicity of different frequency bands into which the input signal is divided.

33. a method according to claim 30 with the different frequencies ($f_G$) being in a range between a value equal to the corresponding mean frequency ($f_m$) and a value equal to one-half of the mean frequency.

* * * * *